US007599633B2

(12) United States Patent
Inoue et al.

(10) Patent No.: US 7,599,633 B2
(45) Date of Patent: Oct. 6, 2009

(54) IMAGE FORMING APPARATUS DUST CONTAINER INCLUDING DUST CONVEYANCE MEMBERS

(75) Inventors: Tomofumi Inoue, Osaka (JP); Takafumi Miyazaki, Osaka (JP); Tomoya Adachi, Osaka (JP); Takeshi Sakashita, Osaka (JP); Yuuji Meguro, Hyogo (JP); Takeru Muramatsu, Osaka (JP); Kohji Hatayama, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 44 days.

(21) Appl. No.: 11/580,939

(22) Filed: Oct. 16, 2006

(65) Prior Publication Data

US 2007/0110458 A1 May 17, 2007

(30) Foreign Application Priority Data

| | | |
|---|---|---|
| Nov. 15, 2005 | (JP) | 2005-330661 |
| Dec. 7, 2005 | (JP) | 2005-353645 |
| Jan. 17, 2006 | (JP) | 2006-008324 |
| Feb. 13, 2006 | (JP) | 2006-035622 |

(51) Int. Cl.
*G03G 21/10* (2006.01)

(52) U.S. Cl. ..... 399/35; 399/360; 399/120

(58) Field of Classification Search ..... 399/360, 399/358, 106, 319, 120, 35, 123; 220/23.4; 206/496

See application file for complete search history.

(56) References Cited

U.S. PATENT DOCUMENTS 4,436,414 A * 3/1984 Kamiyama et al. ..... 399/35
6,339,689 B1 * 1/2002 Sugiura ..... 399/120
7,107,002 B2 * 9/2006 Saito et al. ..... 399/360

FOREIGN PATENT DOCUMENTS

| | | |
|---|---|---|
| JP | 5-204281 | 8/1993 |
| JP | 6-118846 | 4/1994 |
| JP | 6-318015 | 11/1994 |
| JP | 9-80884 | 3/1997 |
| JP | 2630673 | 4/1997 |
| JP | 9-325662 | 12/1997 |
| JP | 10-207202 | 8/1998 |
| JP | 10-282776 | 10/1998 |
| JP | 10-301460 | 11/1998 |

(Continued)

OTHER PUBLICATIONS

U.S. Appl. No. 11/616,664, filed Dec. 27, 2006, Adachi, et al.

*Primary Examiner*—David M Gray
*Assistant Examiner*—G. M. Hyder
(74) *Attorney, Agent, or Firm*—Oblon, Spivak, McClelland, Maier & Neustadt, L.L.P.

(57) ABSTRACT

A dust container includes a container body, an inlet, a dust detector, and a dust-conveying unit. The dust-conveying unit conveys the dust from the inlet to the interior of the container body. The dust-conveying unit includes a plurality of conveying members that are arranged at different positions in the dust conveying unit. A direction in which the dust is conveyed and an amount of the dust conveyed by at least one of the conveying members is different from those of the other conveying members. As the dust accumulates in the container body, the dust detector detects whether the container body is substantially full with the dust.

14 Claims, 10 Drawing Sheets

FOREIGN PATENT DOCUMENTS

| | | | | |
|---|---|---|---|---|
| JP | 11-2947 | | | 1/1999 |
| JP | 2931521 | | | 5/1999 |
| JP | 2000-56648 | | | 2/2000 |
| JP | 2001296779 | A | * | 10/2001 |
| JP | 2001-350381 | | | 12/2001 |
| JP | 2002-23578 | | | 1/2002 |
| JP | 2002-108035 | | | 4/2002 |
| JP | 2003-66800 | | | 3/2003 |
| JP | 2003-156946 | | | 5/2003 |
| JP | 2003-162191 | | | 6/2003 |
| JP | 2004-045451 | | | 2/2004 |
| JP | 2004-77607 | | | 3/2004 |
| JP | 2004-102137 | | | 4/2004 |
| JP | 2004-117392 | | | 4/2004 |
| JP | 2005173388 | A | * | 6/2005 |
| JP | 2005283626 | A | * | 10/2005 |
| WO | 2001350381 | A | * | 12/2001 |

* cited by examiner

IMAGE FORMING APPARATUS DUST CONTAINER INCLUDING DUST CONVEYANCE MEMBERS

CROSS-REFERENCE TO RELATED APPLICATIONS

The present document incorporates by reference the entire contents of Japanese priority document, 2005-330661 filed in Japan on Nov. 15, 2005, Japanese priority document, 2005-353645 filed in Japan on Dec. 7, 2005, Japanese priority document, 2006-008324 filed in Japan on Jan. 17, 2006, and Japanese priority document, 2006-035622 filed in Japan on Feb. 13, 2006.

BACKGROUND OF THE INVENTION

1. Field of the Invention

The present invention relates to a dust container for collecting dust such as toner to accumulate therein, and relates to an image forming apparatus that has the dust container, including a copying machine, a printer, a facsimile, a plotter and the like.

2. Description of the Related Art

In image forming apparatuses such as a copying machine, a cleaning unit removes post-transfer residual toner that is remaining on a photosensitive drum or an intermediate transfer belt after toner image is transferred onto a recording medium or an intermediate member. The toner is collected and accumulated in a waste-toner collecting container in an image forming process. Such waste-dust container includes a toner inlet connected to the cleaning unit, a toner conveying unit that conveys toner accommodated into the container, and a toner detector that detects a degree of toner accommodation, a filling rate, in the container. The waste-toner collecting container is replaced with a new one when the toner detector detects a state in which the container is fully filled with toner. For improving the user's convenience, the replacement operation would be preferably be much reduced, so that it is advisable a capacity of the container be as larger as possible.

However, when there is not much space in a height direction of a main unit of the image forming apparatus due to down-sizing, a form of the waste-toner collecting container becomes broader horizontally and smaller in a height direction inevitably. That is the reason why the container is likely to be formed in a flat shape, which is wide in the horizontal direction and short in the vertical direction.

In such a container shape, it is difficult to accumulate toner evenly therein, where toner can partially agglomerates. The toner detector is provided on a downstream side in a toner flow direction, where the toner detector detects a remaining amount of how much further toner can be accumulated in the cartridge. When toner accumulates around the toner detector in an agglomerated state, the toner detector detects a toner-filled state in the whole of the container, which shows a need of replacement even though the cartridge is of unfilled state, leading to user's inconvenience.

To solve a problem of blocking generation of waste-toner, a technique disclosed in Japanese Patent Application Laid-open No. H11-002947 is to fully replenish toner efficiently while preventing aggregation of toner contained in the cartridge preliminarily. It is disclosed that an eccentric cam is provided on a shaft of a screw that replenishes toner outside, a flat plate is reciprocated in a horizontal direction by the eccentric cam, and toner is conveyed by a reversed V-shaped inward-oriented protrusion formed on the flat plate integrally. However, when the conveying system is applied to the waste-toner collecting container, toner is likely to be accumulated around the toner detector in an agglomerated state, so that the problem of erroneous detection is not solved.

Such techniques are disclosed in Japanese Patent Application Laid-open Nos. H10-207202, H05-204281, and H06-118846 that a configuration for loosening toner that causes blocking. The proposed configuration includes a plate member that can reciprocate arranged in the waste-toner collecting container, a protrusion portion that advances into a toner inflow port so that the inflow toner is provided on the plate member, and the plate member reciprocated to loosen toner by the protrusion portion. In this configuration, a toner amount becomes maximum at a toner introductory portion of the waste-toner collecting container, and a movement amount of the toner is reduced according to a movement from the introductory portion, so that toner is not conveyed to a position where toner is detected by the toner detector. Therefore, such problem has not been solved that waste-toner near the introductory portion of the waste-toner collecting container is scattered to contaminate the inside of the apparatus.

With regard to this problem, to control waste-toner to be accumulated evenly, it is required to make a plurality of different toner flows that are different in direction at different positions at a horizontal plane inside the waste-toner collecting container. FIG. 14 is a sectional view for explaining a waste-toner collecting container used in related arts. FIG. 15 is a sectional view for explaining another waste-toner collecting container used in related arts. To satisfy this requirement, a configuration that toner agitating rods 16 are arranged so as to cover the whole area of a bottom face of a waste-toner collecting container 14, as shown in FIG. 14, and a configuration that many conveying screws 17 are arranged inside the waste-toner collecting container 14, as shown in FIG. 15 behave been proposed, for example.

However, in such related arts, a configuration for driving an agitating unit such as the toner agitating rods 16 or the conveying screws 17 becomes complicated, leading unavoidably expensive. This is because a complicated gear train is required for simultaneously rotating a plurality of agitating units in different directions.

SUMMARY OF THE INVENTION

It is an object of the present invention to at least partially solve the problems in the conventional technology.

According to an aspect of the present invention, a dust container configured to contain dust therein, the dust container includes a container body configured to contain dust therein; an inlet to the container body that lets the dust come therethrough inside the container body; a dust conveying unit that conveys the dust from the inlet to a portion away from the inlet inside the container body, the dust conveying unit including a plurality of conveying members being arranged at different positions in the dust conveying unit, at least one conveying member being different from other conveying members in at least any one of a dust-conveying direction and a dust conveying-amount; and a dust detector that detects whether the container body is substantially full with the dust.

According to another aspect of the present invention, an image forming apparatus configured to form image onto a recording medium by using toner, the image forming apparatus includes a dust container that is configured to contain dust therein, the dust container includes a container body configured to contain dust therein; an inlet to the container body that lets the dust come therethrough inside the container body; a dust conveying unit that conveys the dust from the inlet to a portion away from the inlet inside the container body, the dust conveying unit including a plurality of conveying members being arranged at different positions in the dust conveying unit, at least one of the conveying member being different from other conveying members in at least any one of a dust-conveying direction and a dust conveying-amount; and a dust detector that detects whether the container body is substantially full with the dust.

According to still another aspect of the present invention, an image forming apparatus configured to form image onto a recording medium by using toner, the image forming apparatus includes a waste-toner container that is configured to contain waste-toner therein, the waste-toner container includes a container body configured to contain dust therein; an inlet to the container body that lets the dust come therethrough inside the container body; a dust conveying unit that conveys the dust from the inlet to a portion away from the inlet inside the container body, the dust conveying unit including a plurality of conveying members being arranged at different positions in the dust conveying unit; at least one of the conveying member being different from other conveying members in at least any one of a dust-conveying direction and a dust conveying-amount; and a dust detector that detects whether the container body is substantially full with the dust.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments according to the present invention will be explained below with reference to the accompanying drawings.

Figure 1:
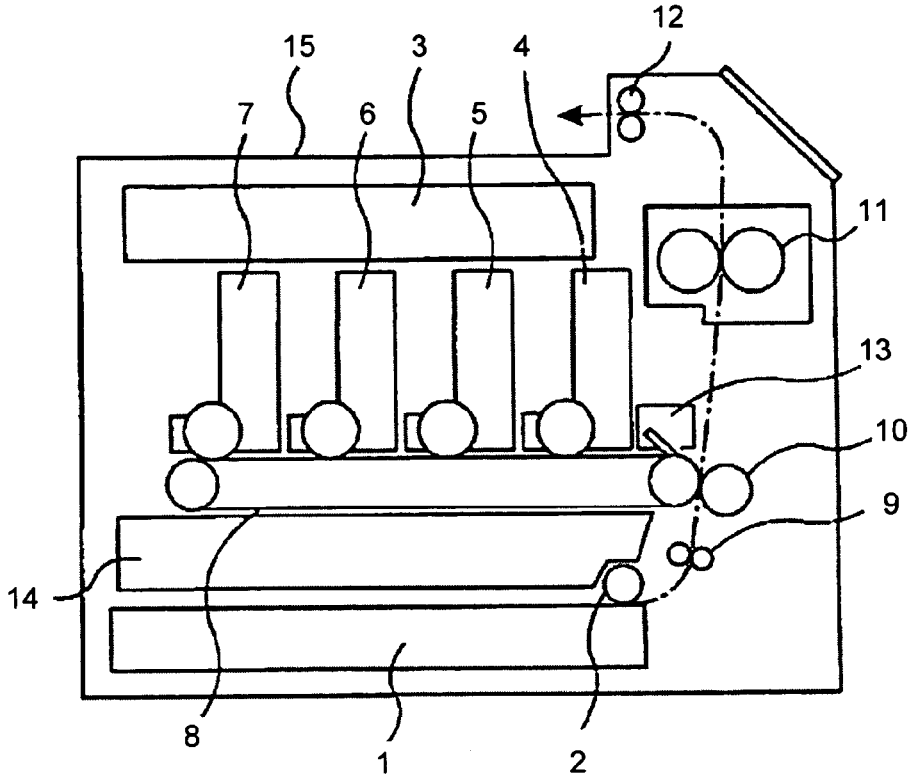
FIG. 1 is a schematic view of an image forming apparatus using a waste-toner collecting container according to a first embodiment of the present invention.

FIG. 1 is a schematic view of an image forming apparatus using a waste-toner collecting container according to a first embodiment of the present invention. In the image forming apparatus shown in FIG. 1, four image forming units 4, 5, 6, and 7 using optical writing system are provided in parallel with one another in a substantially horizontal direction, and are exposed by an exposing unit 3, so as to form electrostatic latent images. Respective electrostatic latent images are made to be visible images using powder toner by developing units, respectively provided as a part of image forming units.

The respective toner images formed on the respective image forming units are sequentially transferred one another on an intermediate transfer belt 8. Transfer paper stacked on a paper cassette 1 is fed by a paper feed roller 2, and is sent to a secondary transfer site at a predetermined timing after a skew is corrected by a registration roller pair 9. Superimposed toner images on the intermediate transfer belt 8 are transferred all together on the transfer paper at the secondary transfer site by a secondary transfer roller 10. Thereafter, a color toner image on the transfer paper is heated and fixed as a visible image by a fixing unit 11, and is discharged as an output image to a paper discharge tray 15 on an upper face of the apparatus by a discharge roller pair 12.

On the other hand, post-transfer residual toner on the intermediate transfer belt 8 is removed from the belt by a cleaning mechanism 13, and is accumulated in a waste-toner collecting container (waste-toner container) 14 as a dust container (waste-toner container).

Such image forming apparatuses have been undergoing downsizing and cost reduction, and also improvement of the user's convenience has been demanded. Accordingly, for improving the user's convenience, it is desired to enlarge a capacity of the container as much as possible to reduce replacements of a waste-toner collecting container. However, it is not easy to enlarge the capacity of the waste-toner collecting container. Therefore, the waste-toner collecting container is often designed to occupy in a dead space in the machine configuration.

In the image forming apparatus according to the first embodiment, since it is required a certain distance from the paper feed roller 2 to the secondary transfer roller 10 for transferring paper, a dead space created is occupied for the waste-toner collecting container.

However, if the waste-toner collecting container is arranged in the dead space, a problem as described below occurs. That is, it is very difficult to accumulate toner evenly because a dimensional ratio of the waste-toner collecting container is large in a lateral direction and in a depth direction, while small in a height direction. If waste-toner is agglomerated and accumulated in a certain part, waste-toner (hereinafter, also "toner") is not conveyed and clogged well, which causes a problem that the detection accuracy of how much waste-toner is accumulated inside. In such a waste-toner collecting container, to control toner accumulating evenly, a complicated configuration provided with agitating units are required for making a plurality of flows different in direction at different positions on a horizontal plane (parallel to a broader face) thereof. In this case, since a complicated gear train is needed to rotate the plurality of agitating units simultaneously in different directions, the apparatus inevitably becomes expensive.

Figure 2:
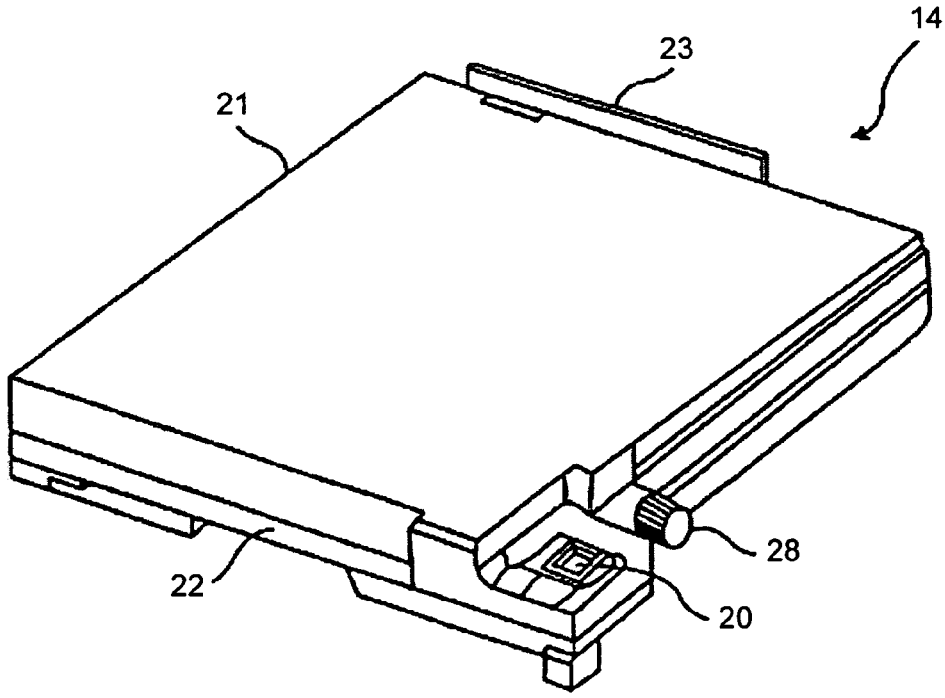
FIG. 2 is a perspective view of the waste-toner collecting container shown in FIG. 1.

Details of the waste-toner collecting container according to the first embodiment will be explained below. FIG. 2 is a perspective view of the waste-toner collecting container shown in FIG. 1. As shown in FIG. 2, the waste-toner collecting container 14 includes an upper case 21 having a waste-toner inlet 20 as a dust inlet, a lower case 22, a waste-toner accumulation detecting unit 23. A waste-toner transfer hose (not shown) extends from the cleaning mechanism 13 to be connected to the waste-toner inlet 20 to discharge waste-toner into the waste-toner collecting container. Besides, a drive gear 28 connects to a drive source (not shown) of the image forming apparatus.

Figure 3:
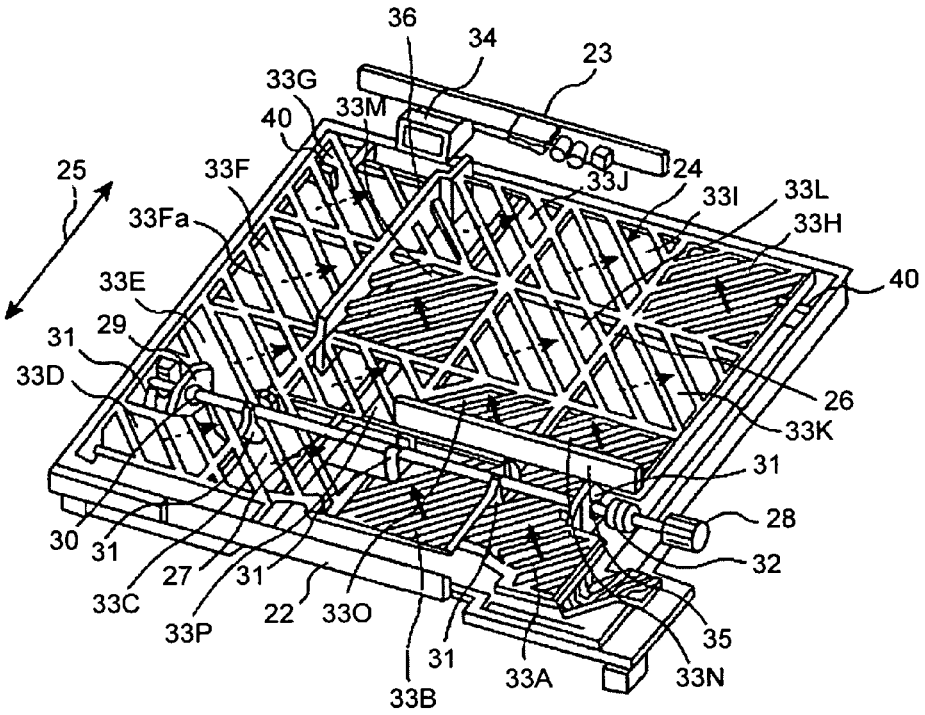
FIG. 3 is a perspective view of conveying directions in respective conveying units in the waste-toner collecting container shown in FIG. 2.

FIG. 3 is a perspective view of conveying directions in respective conveying units in the waste-toner collecting container shown in FIG. 2. As shown in FIG. 3, a dust conveying unit 24 as a waste-toner conveying unit is received in the lower case 22. The dust conveying unit 24 includes an agitating plate 26 that performs a substantial reciprocating movement in a direction of an arrow 25, a camshaft 27, a drive gear 28 fixed at one end portion of the camshaft 27 and connected to the drive source (not shown) of the image forming apparatus, an eccentric cam 30 provided at the other end portion of the camshaft 27 and accommodated in a cam receiving portion 29 formed on the agitating plate 26 integrally, and the like.

The camshaft 27 is supported by a plurality of supporting pieces 31 integrally formed on the agitating plate 26. The camshaft 27 is divided into two shaft sections at the drive gear 28 side, where the shaft sections are connected by a coupling 32. Further, a supporting member 40 that supports an end portion of the drive gear side of the agitating plate 26 from the lower side is provided to opposes to the agitating plate.

The waste-toner accumulation detecting unit 23 includes a waste-toner accumulation detector 34 as a dust detector. As the waste-toner accumulation detector 34, for example, a light reflection type photo-sensor can be used.

The agitating plate 26 is integrally formed of synthetic resin, and conveying units 33A, 33B, 33C, . . . , 33P are divided into 16 blocks at different positions on a substantially horizontal plane of the agitating plate 26. The respective conveying units 33A, 33B, 33C, . . . , 33P are partitioned to be rectangular shaped by ribs running horizontally, and are provided with conveying members (for example, a conveying unit 33F is provided with a conveying member 33Fa) of a plurality of shuttering plate structures, of which plate have an angle to a movement direction of the dust conveying unit 24 (a reciprocating direction indicated by the arrow 25) on the substantially horizontal plane, so that waste-toner is pushed and moved. Conveying members 33Aa, 33Ba, 33Ca, . . . , 33Pa include a plurality of shuttering plate structures so that waste-toner can be pushed and moved properly.

Figure 4:
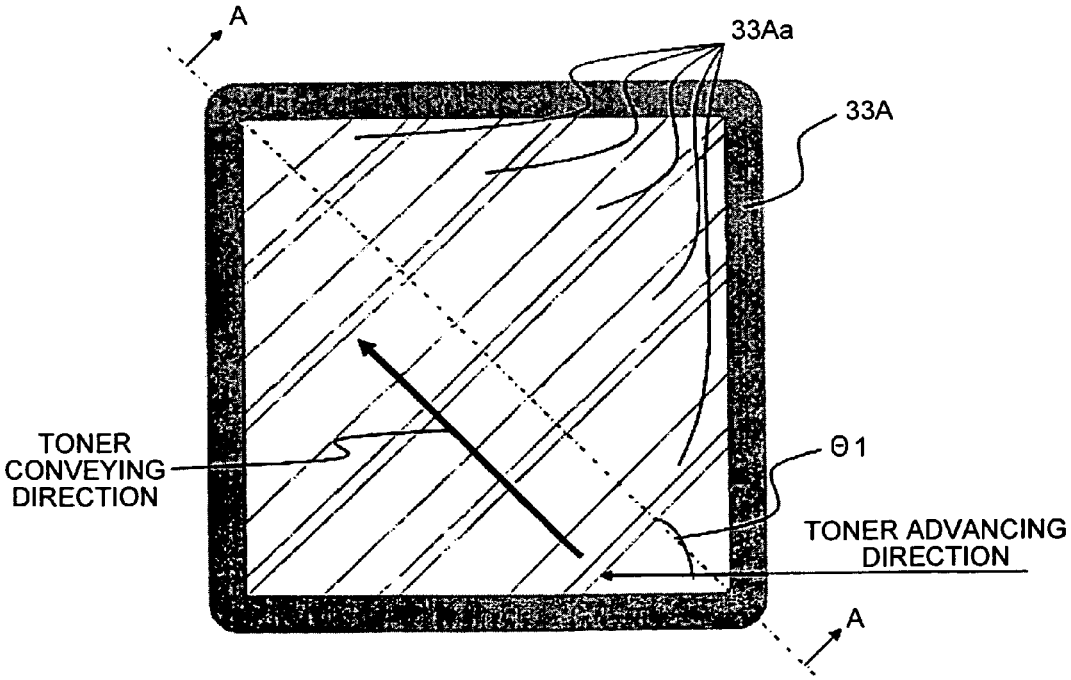
FIG. 4 is an enlarged front view of a conveying unit of the waste-toner collecting container shown in FIG. 3.

Details of the shuttering plate structure will be explained below. FIG. 4 is an enlarged front view of a conveying unit of the waste-toner collecting container shown in FIG. 3. The conveying unit 33A has an oblong shape or a substantial square shape, and includes a plurality of conveying member 33Aa within frame of the conveying unit 33A. As shown in FIG. 4, when a setting angle of the conveying member 33Aa to a waste-toner advancing direction is set represented as θ1, waste-toner is conveyed in a direction of θ1+90 degrees (a direction of a thick arrow in FIG. 4) due to reciprocation of the conveying unit.

Figure 5:
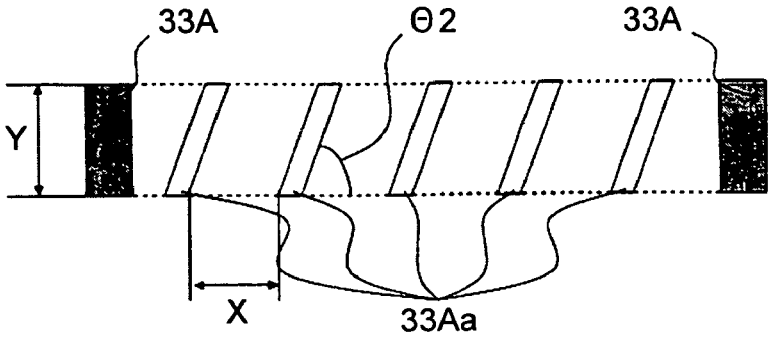
FIG. 5 is a sectional view of the conveying unit of the waste-toner collecting container taken along a line A-A shown in FIG. 4.

FIG. 5 is a sectional view of the conveying unit of the waste-toner collecting container taken along a line A-A shown in FIG. 4. In FIG. 5, a distance between adjacent the conveying members 33Aa is represented as X, a height of the conveying unit is represented as Y, and a mounting angle from a horizontal plane of the conveying member 33Aa is represented as θ2. A waste-toner conveying amount can be changed by adjusting the X, Y, and θ2, and further by adjusting the mounting number of the conveying members 33Aa. In FIG. 5, five conveying members 33Aa are mounted.

By mounting many kinds of conveying members having such a shuttering plate structure, the conveying unit is configured so as to differ in at least any one of a conveying direction and a conveying amount of waste-toner that moves on each conveying member. For example, a waste-toner amount increases when an interval between shuttering plates (distance X) of a conveying member is set smaller than that with a large distance. In FIG. 3, since distances between shuttering plates of the conveying members 33Aa, 33Ba, 33Ha, 33Ma, 33Na, and a 33Oa are smaller than distances between shuttering plates of the remaining conveying members 33Ca, 33Da, 33Ea, 33Fa, 33Ga, 33Ia, 33Ja, 33Ka, 33La, and 33Pa, leading a toner conveying amount to increase.

In FIG. 3, the conveying members 33Aa, 33Ba, 33Ca, . . . , 33Pa are obliquely arranged at almost even intervals, and a groove is formed between adjacent conveying members. The conveying units 33A, 33B, 33C, . . . , 33P include two kinds of units that are different in conveying direction, for example, conveying units that convey toner in an upper and left oblique direction in FIG. 3 such as a 33H-type, and conveying units that convey toner rightward in FIG. 3 such as a 33K-type.

Conveying directions of toner in the conveying units 33A, 33B, 33H, 33M, 33N, and 33O are directions indicated by solid arrows, while conveying directions in the conveying units 33C, 33D, 33E, 33F, 33G, 33I, 33J, 33K, 33L, and 33P are directions indicated by dashed arrows. Therefore, the conveying directions of the conveying units 33A, 33B, 33M, 33N, 33O, and 33G of these conveying units are directions approaching to the waste-toner accumulation detector 34, while the conveying directions of the conveying units 33I, 33J, 33K, and 33L are directions departing from the waste-toner accumulation detector 34.

A partition plate 35 extending in parallel to the camshaft 27 is integrally formed with the upper faces of the conveying units 33N and 33O. The partition plate 35 regulates a flow of waste-toner on the upper portions of the conveying units 33N and 33O. A partition plate 36 extending in a direction perpendicular to the camshaft 27 is integrally formed with the conveying units 33F, 33G, 33J, and 33M. The partition plate 36 regulates flows of waste-toner above and below the conveying units 33F, 33G, 33J, and 33M between the conveying units 33F and 33G and the conveying units 33J and 33M. The partition plates 35 and 36 are set at positions where colliding a toner flow generated by the conveying units.

Figure 6:
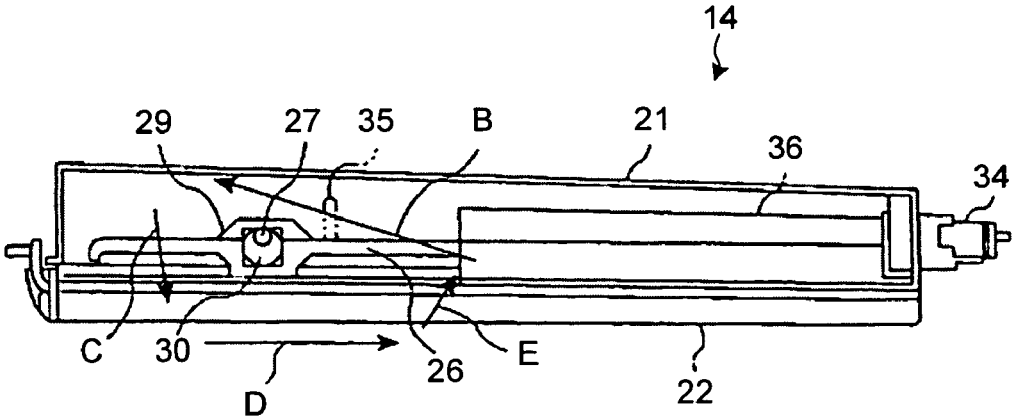
FIG. 6 is a schematic sectional view of the waste-toner collecting container for explaining a reciprocation of an agitating plate shown in FIG. 3.

FIG. 6 is a schematic sectional view of the waste-toner collecting container for explaining a reciprocation of an agitating plate shown in FIG. 3. In FIG. 6, like members shown in FIG. 3 are designated with like letters or numerals, and explanation thereof is omitted. As shown in FIG. 6, the waste-toner collecting container 14 is provided with the upper case 21 and the lower case 22, the waste-toner accumulation detector 34 is at the right end of the waste-toner collecting container 14, and the partition plates 35 and 36 are inside the waste-toner collecting container 14.

In FIG. 6, when the camshaft 27 rotates, since the eccentric cam 30 is received in the cam receiving portion 29 formed integrally with the agitating plate 26, the agitating plate 26 first moves to the left side in FIG. 6 so as to float as indicated by an arrow B, subsequently advances slightly to the right while descending as indicated by an arrow C, advances substantially horizontally to the right as indicated by an arrow D, and subsequently advances slightly to the right and moves obliquely upward as indicated by an arrow E. The agitating plate 26 performs a substantial reciprocating movement as a whole, while repeating the movements.

Thereby, in FIG. 6, at the time of a forward movement in a direction indicated by letter D, a plurality of the conveying units 33A, 33B, 33C, . . . , 33P can push and move toner according to a movement of the agitating plate 26 moving along the bottom face of the lower case 22. To the contrary, at the time of a backward movement in directions indicated by letters E and B, a plurality of the conveying units 33A, 33B, 33C, . . . , 33P float and move, because the agitating plate 26 floats from the bottom face of the lower case 22. As a result, toner hardly moves at the time of the backward movement in the directions indicated by the letters E and B.

By using a single driving source, a plurality of the conveying units 33A, 33B, 33C, . . . , 33P with different in conveying direction can reciprocate simultaneously without using a complicated gear train. When the agitating plate 26 performs reciprocation as described above, different conveying flows are generated at the respective conveying units.

Figure 7A:
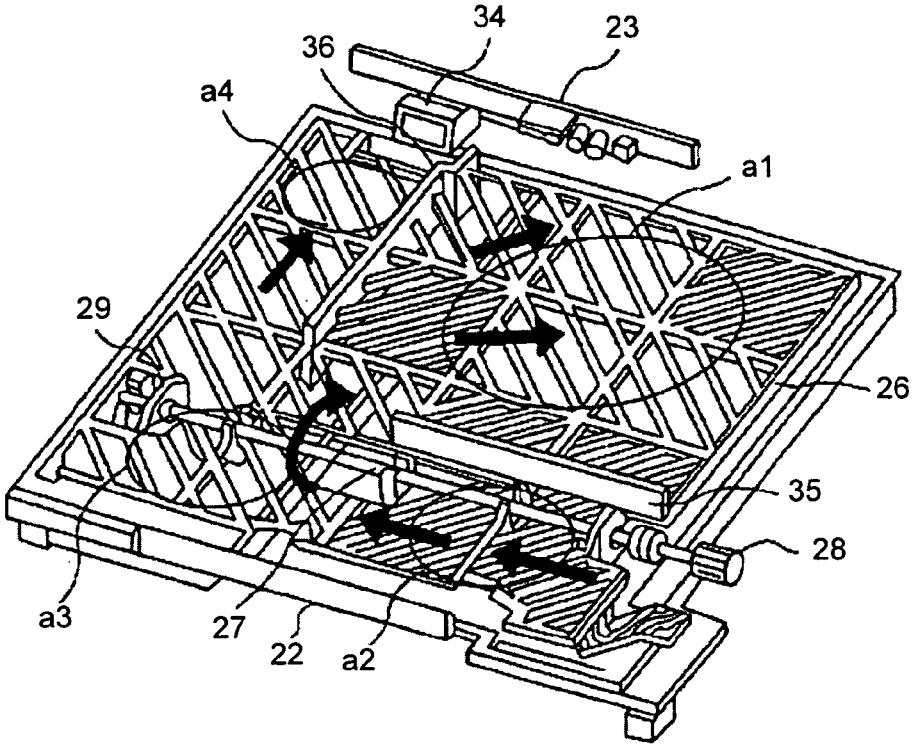
FIG. 7A is a perspective view of a conveying flow in the waste-toner collecting container shown in FIG. 3.
Figure 7B:
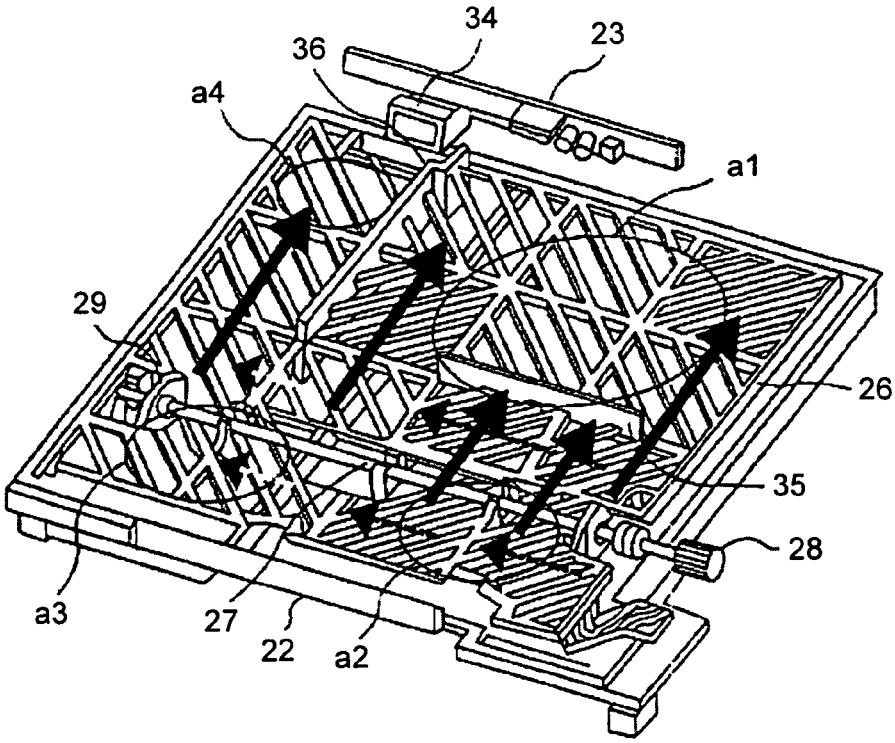
FIG. 7B is a perspective view of another example of a conveying flow in the waste-toner collecting container shown in FIG. 3.

Conveying flow in the waste-toner collecting container according to the first embodiment will be explained below. FIG. 7A is a perspective view of a conveying flow in the waste-toner collecting container according shown in FIG. 3. FIG. 7B is a perspective view of another example of a conveying flow in the waste-toner collecting container shown in FIG. 3. In FIGS. 7A and 7B, like members shown in FIG. 3 are designated with like letters or numerals, and explanation thereof is omitted. In FIG. 7A, the waste-toner collecting container is divided into four conveying area of a conveying area a1 partitioned by the partition plates 35 and 36, a conveying area a2 near the waste-toner collecting container inlet, a conveying area a3 by the cam receiving portion 29, and a conveying area a4 near the waste-toner accumulation detector 34.

First, in the conveying area a2 near the drive gear, a conveying amount is large because a distance between shuttering plates is short, and toner is conveyed to a bordering portion with the conveying area a3. The toner is then conveyed sequentially into a back of the conveying area a1. In the conveying area a3, a conveying amount is small because a distance between shuttering plates is long, and toner is conveyed gradually. Finally, the toner is conveyed to the conveying area a4 to be filled therein. As shown in FIG. 7A, a conveying flow as indicated by a thick black arrow is generated as a whole.

FIG. 7B depicts an overall flow in the waste-toner collecting container in case of providing the partition plate 35 at a different position. In this example, as shown in FIG. 7B, a conveying flow as indicated by a thick black arrow is generated as a whole, so that the area a1 partitioned by the partition plates 35 and 36, the area a2 near the waste-toner inlet 20, and the area a3 near the cam receiving portion 29 are filled with toner in this order, and finally the area a4 near the waste-toner accumulation detector 34 is filled with toner.

In this manner, the conveying flow in the waste-toner collecting container can be delicately controlled by two kinds of areas different in the conveying direction and conveying amount, namely, by respective arrangement pattern of the conveying units 33A, 33B, 33H, 33M, 33N, and 33O, and the conveying units 33C, 33D, 33E, 33F, 33G, 33I, 33J, 33K, 33L, and 33P. As a result, although the conveying area a4 near the waste-toner accumulation detector 34 is finally filled with waste-toner, the waste-toner is conveyed without being clogged in the other conveying areas a1, a2, and a3 described above, so that scattering of waste-toner near the inlet of the waste-toner collecting container, or erroneous fullness detection of waste-toner due to waste-toner blocking can be prevented.

Further, in FIG. 3, the supporting member 40 that supports the end portion of the agitating plate 26 at the waste-toner accumulation detector 34 side from the lower face side of the agitating plate 26 is provided near the waste-toner accumulation detector 34 of the lower case 22 so as to face the agitating plate 26. A function of the supporting member 40 will be explained with reference to FIG. 8A, FIG. 8B, FIG. 8C, and FIG. 8D.

Figure 8A:
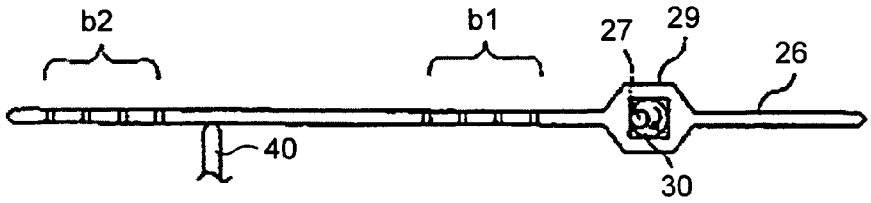
FIG. 8A is a schematic view for explaining a mechanism of reversing a conveying direction in the waste-toner collecting container shown in FIG. 3.
Figure 8B:
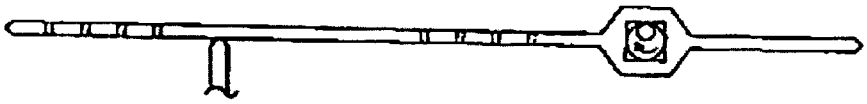
FIG. 8B is another schematic view for explaining a mechanism of reversing a conveying direction in the waste-toner collecting container shown in FIG. 3.
Figure 8C:
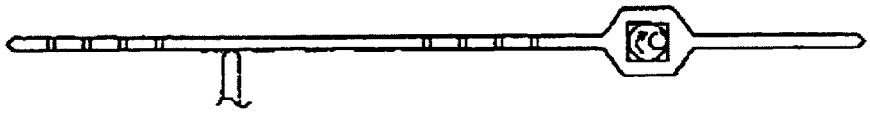
FIG. 8C is still another schematic view for explaining a mechanism of reversing a conveying direction in the waste-toner collecting container shown in FIG. 3.
Figure 8D:
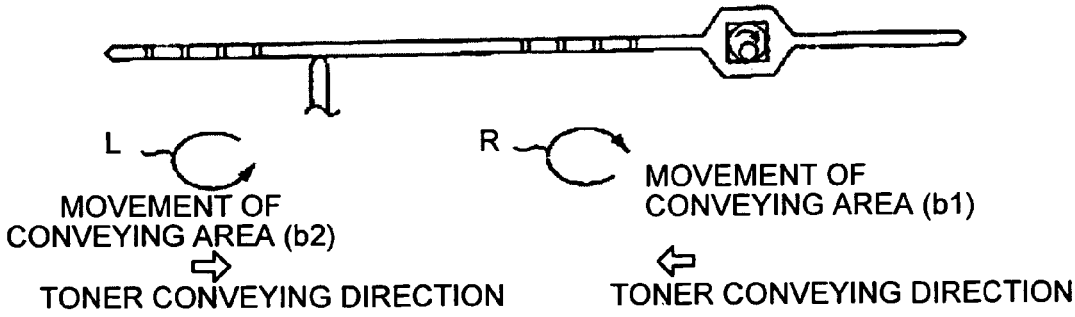
FIG. 8D is a still another schematic view for explaining a mechanism of reversing a conveying direction in the waste-toner collecting container shown in FIG. 3.

FIG. 8A, FIG. 8B, FIG. 8C, and FIG. 8D are schematic views for explaining a mechanism of reversing a conveying direction in the waste-toner collecting container shown in FIG. 3. FIG. 8A explains a mechanism of reversing a conveying direction with regard to the supporting member due to reciprocation when the agitating plate in the waste-toner collecting container is supported by the supporting member. FIG. 8A to FIG. 8D show the agitating plate 26 viewed from the cam receiving portion 29 side, representing aspects of the agitating plate 26 moved vertically by the eccentric cam 30.

When reciprocation is performed in a state that the end portion of the agitating plate 26 at the side distant from the eccentric cam 30 is supported by the supporting member 40, toner is conveyed in directions reverse each other at both sides of the supporting member 40. In FIG. 8A, in the conveying area (b1) near the eccentric cam 30, the agitating plate 26 moves (arrow R) as if to scoop toner in the container upward, so that the toner conveying direction becomes leftward.

On the other hand, in the conveying area (b2), although the conveying area (b2) has the same configuration as the conveying area (b1), the agitating plate 26 moves (arrow L) to scrape toner in the container downward, so that the toner conveying direction becomes rightward.

To exploit the advantage of this characteristic, the supporting member 40 is arranged so as to generate a conveying flow in a direction moving away from the waste-toner inlet 20 in the conveying area (b1) that is a part near the waste-toner inlet 20, and a conveying flow advancing to the waste-toner inlet 20 in the conveying area (b2) that is a portion distant from the waste-toner inlet 20, so that the conveying flows as described above are obtained as a whole.

According to the waste-toner collecting container according to the first embodiment, in the image forming apparatus, even a space which is short in height likes a dead space can be utilized for a waste-toner collecting container which is free from a blocking therein due to the toner accumulation and is free from erroneous toner detection by the waste-toner.

Figure 9:
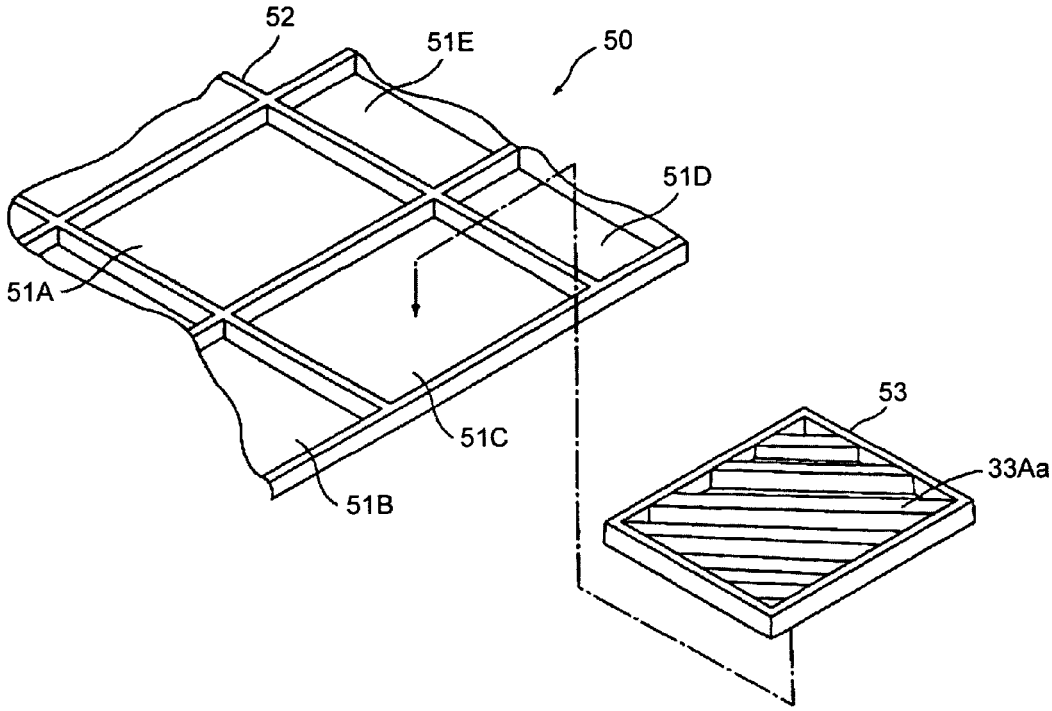
FIG. 9 is a perspective view for explaining a conveying unit in a waste-toner collecting container according to a second embodiment of the present invention.

Details of a waste-toner collecting container according to a second embodiment of the present invention will be explained below. As for the inside of an image forming apparatus according to the second embodiment, a configuration and an operation thereof are similar to those of the first embodiment, so that like constituent elements are designated with like letters or numerals, and explanation thereof is omitted. The second embodiment differs in an agitating plate of a conveying unit from that of the first embodiment. FIG. 9 is a perspective view for explaining a conveying unit in a waste-toner collecting container according to a second embodiment of the present invention.

As shown in FIG. 9, an agitating plate 50 in the waste-toner collecting container according to the second embodiment includes a frame member 52 including a plurality of partitions 51A, 51B, 51C, 51D, 51E, and the like. A conveying units 53 is attachable to and detachable from the partitions 51A, 51B, 51C, 51D, 51E of the frame member 52 via an engagement configuration, which is not shown, for example a fitting configuration with a recess and a projection can be used. The conveying unit 53 is attached with the conveying members 33Aa explained in the first embodiment.

According to the attachable and detachable configuration, when at least one kind of the conveying members 33Aa is manufactured, any pattern different in conveying direction can be formed by attaching the conveying units 53 mounted with the conveying member 33Aa to the partitions at different orientations, so that a manufacturing cost, for example a mold cost, can be reduced. Further, as plural kinds of the conveying members 33Aa different in a shuttering plate configuration are explained in the first embodiment, many patterns can be freely formed, and fine adjustment can be facilitated.

The waste-toner collecting container according to the second embodiment has a agitating plate 50 having the above-mentioned configuration instead of the agitating plate 26 in FIG. 3.

According to the waste-toner collecting container according to the second embodiment, can be reduced the manufacturing cost of an agitating plate for preventing scattering of waste-toner and erroneous detection occurring in the waste-toner accumulation detecting sensor due to accumulation of waste-toner and blocking associated with the accumulation, which is shown in the waste-toner collecting container according to the first embodiment. That is, if only at least one kind of conveying member is manufactured, can be freely formed a conveying pattern different in conveying direction in the waste-toner collecting container.

Figure 10:
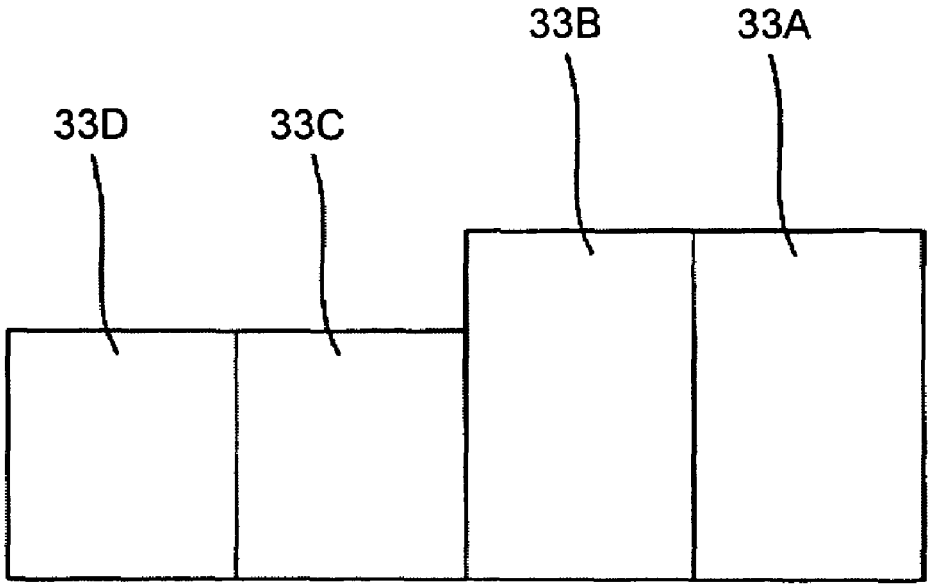
FIG. 10 is a sectional view of relevant parts in a conveying unit in a waste-toner collecting container according to a third embodiment of the present invention.

Details of a waste-toner collecting container according to a third embodiment of the present invention will be explained below. As for the inside of an image forming apparatus according to the third embodiment, a configuration and an operation thereof is similar to those of the first embodiment, so that like constituent elements are designated with like letters or numerals, and explanation thereof is omitted. The third embodiment differs in an agitating plate in a conveying unit from the first and the second embodiments. FIG. 10 is a sectional view of relevant parts in a conveying unit in a waste-toner collecting container according to a third embodiment of the present invention.

FIG. 10 depicts a section of the conveying unit in FIG. 3 viewed from the front side of FIG. 3. The conveying units 33D, 33C, 33B, and 33A are aligned in this order from the left, where heights of the conveying units 33B and 33A are higher than those of the other two conveying units 33D and 33C to increase a conveying amount. By varying the heights of the conveying units, faces of the conveying units 33A, 33B, 33C, . . . , 33P contacting with waste-toner, namely, areas thereof that push and move toner differs from one another. As a result, waste-toner conveying amounts due to shuttering plate structures of the conveying units 33A, 33B, 33C, . . . , 33P are different from one another, so that an effect can be achieved similar to that of the waste-toner collecting container according to the first embodiment.

According to the waste-toner collecting container according to the third embodiment, since a contacting face with toner is changed by making the heights of the conveying units different, can be obtained an effect of preventing scattering of waste-toner and erroneous detection occurring in the waste-toner accumulation detecting sensor due to accumulation of waste-toner and blocking associated with the accumulation by a simple configuration.

The arrangement pattern of the respective conveying units 33A, 33B, 33C, . . . , 33P is not limited to the first embodiment to the third embodiment, and can be determined the most suitable pattern according to conditions such as toner flow characteristics by an experiment or the like.

Figure 11A:
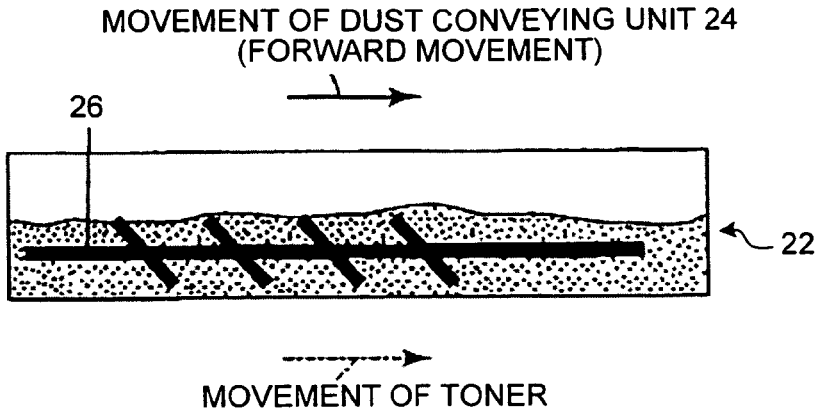
FIG. 11A is a sectional view for explaining an operation of a conveying unit in a waste-toner collecting container at a forward movement according to a fourth embodiment of the present invention.
Figure 11B:
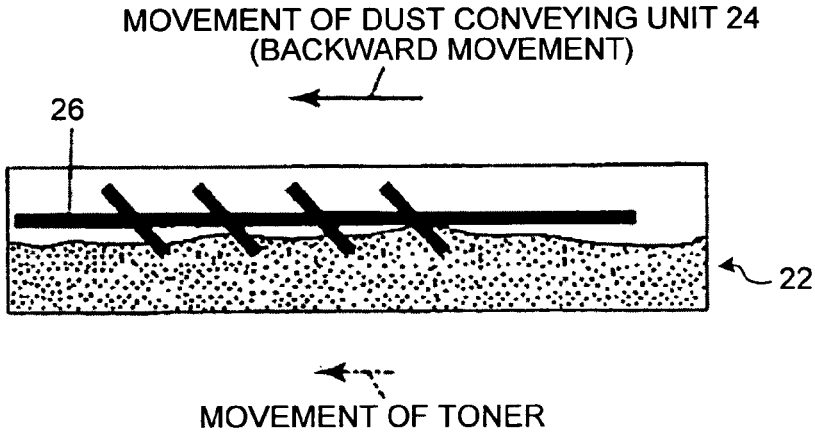
FIG. 11B is a sectional view for explaining an operation of the conveying unit in the waste-toner collecting container at a backward movement according to the fourth embodiment.
Figure 11C:
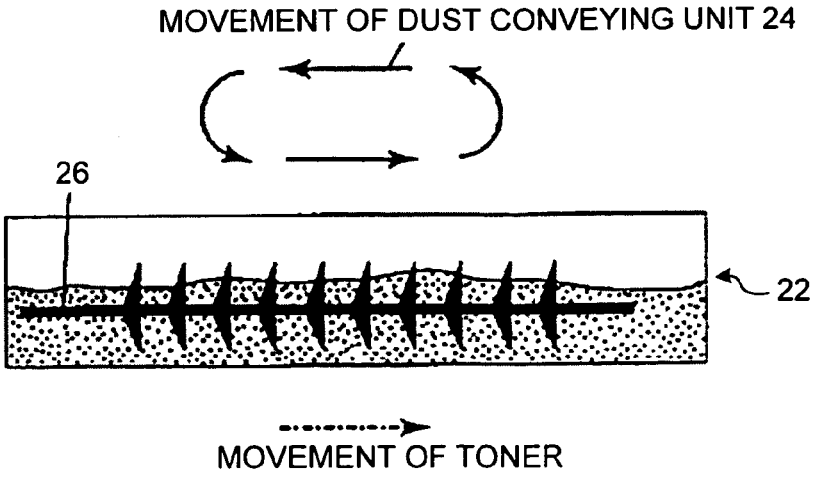
FIG. 11C is a sectional view for explaining a modified conveying unit in the waste-toner collecting container according to the fourth embodiment.

Details of a waste-toner collecting container according to a fourth embodiment of the present invention will be explained below. As for the inside of an image forming apparatus according to the fourth embodiment, a configuration and an operation thereof are similar to those of the first embodiment, so that like constituent elements are designated with like letters or numerals, and explanation thereof is omitted. The fourth embodiment is different in an agitating plate of a conveying units from the first embodiment to the third embodiment. FIGS. 11A to 11C are sectional views for explaining an operation of a conveying unit in a waste-toner collecting container at a forward movement according to a fourth embodiment of the present invention.

FIG. 11A is a sectional view for explaining an operation of a conveying unit in a waste-toner collecting container at a forward movement according to a fourth embodiment of the present invention. FIG. 11B is a sectional view for explaining an operation of the conveying unit in the waste-toner collecting container at a backward movement according to the fourth embodiment. As shown in FIG. 11A, the agitating plate 26 includes blades for waste-toner conveyance mounted on a supporting shaft in an inclined manner. At the time of a forward movement of the dust conveying unit 24, the agitating plate 26, mounted as a part of the dust conveying unit 24, moves along the bottom face of the lower case 22. Accordingly, inclined blades mounted on the agitating plate 26 can push and move waste-toner. On the contrary, as shown in FIG. 11B, since the agitating plate 26 moves floating from the lower case 22 at the time of a backward movement of the dust conveying unit 24, the agitating plate 26 moves backward for the next forward movement hardly moving toner.

As explained above, in the fourth embodiment, it is supposed that the blades provided on the supporting shaft serve as the conveying members, shuttering plate portions, in the first embodiment. FIG. 11C is a sectional view for explaining a modified conveying unit in the waste-toner collecting container according to the fourth embodiment As a modification of the fourth embodiment, as shown in FIG. 11C, cone-shaped blades having a vertical surface facing in a forward direction of the blades provided on the agitating plate 26 can be configured. FIG. 11C depicts a state that the cone-shaped blades advance along the bottom face of the lower case 22. Like the configurations in FIGS. 11A and 11B, due to reciprocation of the dust conveying unit 24, the vertical portions of the blades convey toner at the time of the forward movement, and the cone-shaped portions thereof allow toner to escape, where only agitating is performed as the time of the backward movement.

According to the waste-toner collecting container according to the fourth embodiment, since a remarkably simple configuration where a plurality of blade-shaped portions is attached on the agitating plate 26 is adopted, can be obtained an effect of preventing scattering of waste-toner and erroneous detection occurring in the waste-toner accumulation detecting sensor due to accumulation of waste-toner and blocking associated with the accumulation by a simple configuration.

Details of a waste-toner collecting container according to a fifth embodiment of the present invention will be explained below. As for the inside of an image forming apparatus according to the fifth embodiment, a configuration and an operation thereof is similar to that of the first embodiment, so that like constituent element are designated with like letters or numerals, and explanation thereof is omitted. The fifth embodiment is different from the first to fourth embodiments in that a configuration where a pressurizing mechanism 100 is provided inside the waste-toner collecting container 14 in addition to the agitating plate 26.

Figure 12:
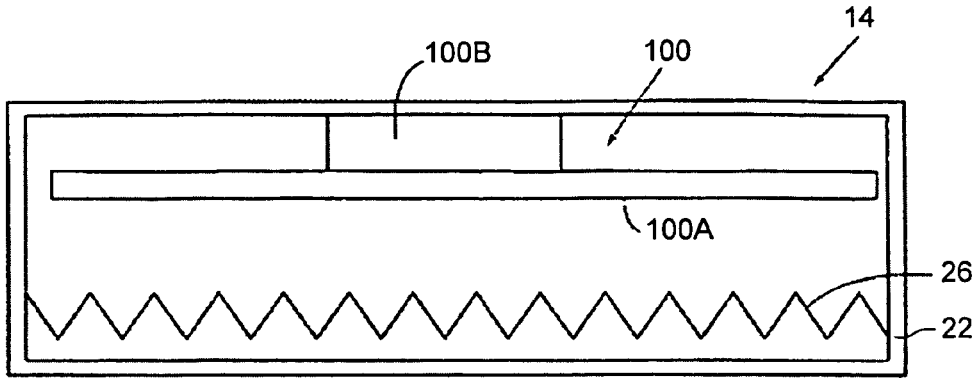
FIG. 12 is a schematic view for explaining an internal configuration of a waste-toner collecting container according to a fifth embodiment of the present invention.

FIG. 12 is a schematic view for explaining an internal configuration of a waste-toner collecting container according to a fifth embodiment of the present invention. FIG. 12 depicts an internal configuration of the waste-toner collecting container according to the fifth embodiment, where the pressuring mechanism 100 that can pressurize toner fed by the agitating plate 26 is provided near the agitating plate 26, which is a toner conveying unit inside the waste-toner collecting container 14. The pressurizing mechanism 100 is used in combination with the agitating plate 26, and includes a pressuring member 100A that can reciprocate in a height direction of the waste-toner collecting container 14, and a drive unit 100B that drives the pressurizing member 100A in a vertical direction. The agitating plate 26 is formed in a corrugated plate-like shape, prevents waste-toner from accumulation, and prevents blocking or the like.

The pressurizing member 100A has a plan view size that can cover almost entire occupation area of the agitating plate 26, and can face the entire area of an accumulating portion of toner fed by the agitating plate 26. As shown in FIG. 12, a solid plate member is used as the pressurizing member 100A when the agitating plate 26 is disposed at a position near the bottom face of the lower case 22, however, the pressuring member 100A can include through-holes such as a meshed member for allowing fed toner to fall toward the lower case 22, when the pressurizing member 100A is positioned below the agitating plate 26.

The drive unit 100B is a member that drives the pressuring member 100A to ascend and descend, where an ascending and descending stroke of the pressurizing member 100A can be set so as to make flat a fed toner in a height direction thereof by causing the pressurizing member 100A to press the toner. The stroke is also set such that agglomeration of toner due to pressurizing is not caused when the pressurizing member 100A flattens the toner. In the fifth embodiment, the ascending and descending stroke is set equal to or more than 1 millimeter. Drive force is obtained from an independent drive source or by working the drive unit 100B through linkage with the eccentric cam 30 that is the drive source of the agitating plate 26 (see FIG. 3).

In the fifth embodiment, toner fed by the agitating plate 26 is flattened by the pressurizing member 100A of the pressurizing mechanism 100 in a vertical movement up and down at each area. Thereby, an accumulating height of toner is made constant, and a space present between toner particles is narrowed, so that a surplus space generates that can accumulate more toner. As a result, when height variation is generated, does not easily happen an erroneous detection of toner-filled state of the container caused by detecting toner at the highest position in an accumulating height. Besides, can be secured a containing amount corresponding to an actual toner-filled state to the volume of the waste-toner collecting container 14.

The pressurizing mechanism 100 can be combined with a conveying screw that can feed toner or the like instead of the agitating plate 26. Further, the pressurizing mechanism 100 can be configured to also serve as a conveying unit by utilizing a movement mode of the agitating plate 26 without providing the conveying unit independently from the agitating plate 26.

Figure 13:
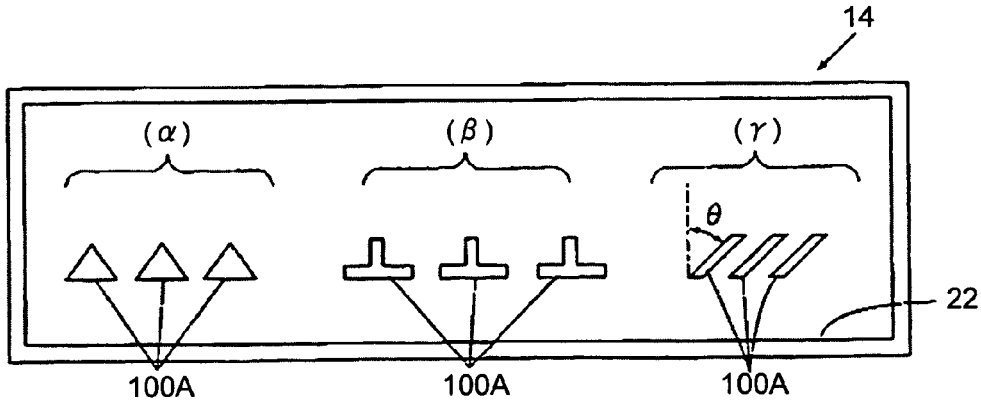
FIG. 13 is a schematic view for explaining a pressuring member pressing accumulated toner to make the accumulated toner height even according to the fifth embodiment.
Figure 14:
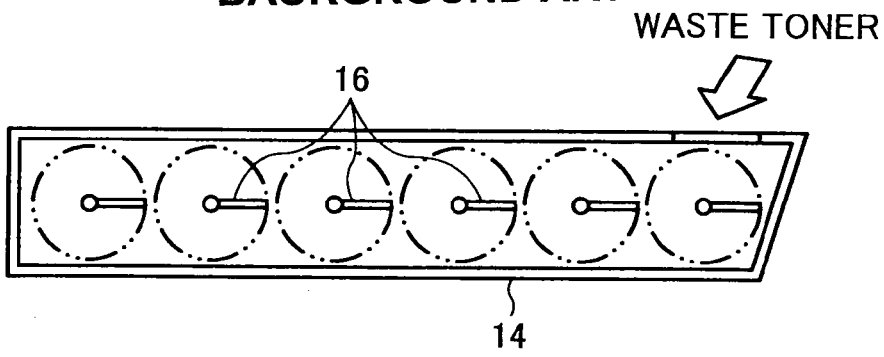
FIG. 14 BACKGROUND ART
FIG. 14 is a sectional view for explaining a waste-toner collecting container used in related arts.
Figure 15:
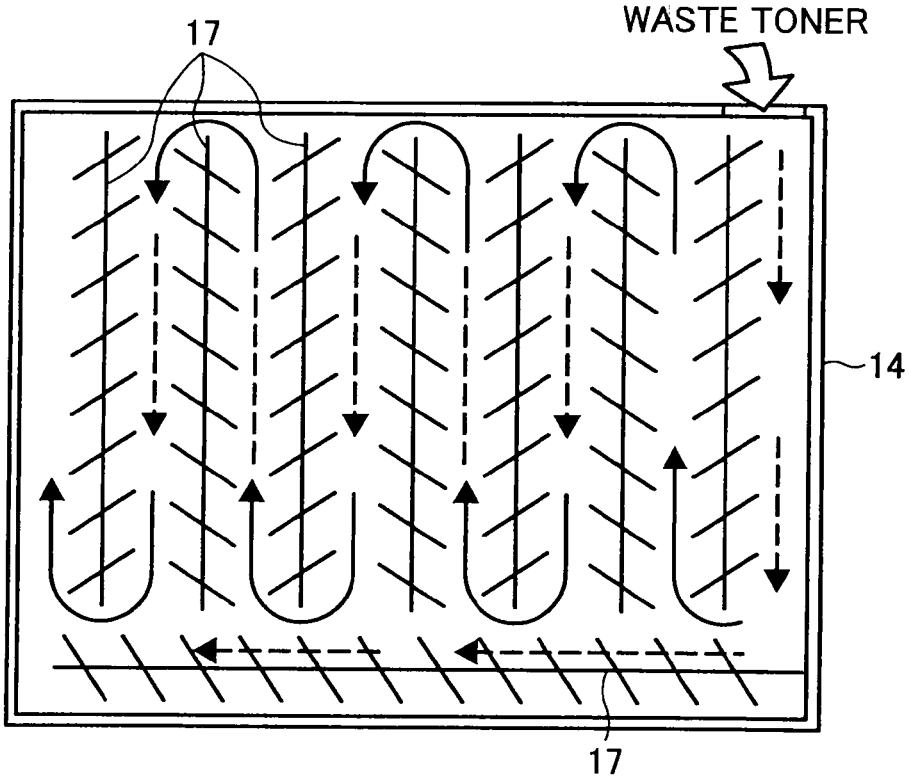
FIG. 15 BACKGROUND ART
FIG. 15 is a sectional view for explaining another waste-toner collecting container used in related arts.

FIG. 13 is a schematic view for explaining a pressuring member pressing accumulated toner to make the accumulated toner height even according to the fifth embodiment. FIG. 13 depicts a configuration adopted when the pressuring member 100A makes toner height constant, where embodiments are shown collectively for convenience. In FIG. 13, a rib of the pressuring member 100A can be formed in a triangle shape in section whose base is parallel with a bottom face of the lower case 22 of the waste-toner collecting container 14, as indicated by letter ($\alpha$), in an inverted T shape as indicated by letter ($\beta$), and in a shape formed in an inclined plates by setting an angle $\theta$, preferably for example −70 degrees to +70 degrees, to a perpendicular vertical line to the plane of the face of the lower case 22 as indicated by letter ($\gamma$). In every case, when the pressuring member 100A ascends or descends, toner is easily pressed and flattened by enlarging a face contacting with toner positioned below the pressurizing member 100A to increase a compression rate. It is possible to use some of the shapes described above in combination with one another. By employing such a configuration, toner height can be made constant by utilizing a movement mode for toner feed. In addition, a toner containing space can be increased by narrowing a space present between toner particles.

According to the waste-toner collecting container according to the fifth embodiment, since the pressurizing member 100A, that includes a rib shape where a contacting area with toner is set to be large as much as possible, is moved vertically to convey and pressurize toner so as to accumulate toner evenly from the container bottom face inside the waste-toner container with no gaps, an effect can be achieved of preventing scattering of waste-toner and erroneous detection occurring in the waste-toner accumulation detecting sensor due to accumulation of waste-toner and blocking associated with the accumulation by a simple configuration.

As described above, the first to fifth embodiments of the present invention are exemplified as an internal configuration of the waste-toner collecting container using toner as dust. However, the embodiment of the present invention is utilized similarly in a container that collects dust or powder other than toner to accumulate the same. The embodiment of the present invention can be also utilized as a toner container.

Furthermore, as another aspect of the dust container, different movement modes are set for the forward route and the backward route for the dust conveying unit.

Further, as another aspect of the dust container, different movement orbits are set for the forward route and the backward route for the dust conveying unit.

Further, as another aspect of the dust container, different movement orbits in a height direction are set for the forward route and the backward route for the dust conveying unit.

Further, as another aspect of the dust container, different inclinations of the movement orbits are set for the forward route and the backward route for the dust conveying unit.

Further, as another aspect of the dust container, different movement speed of the conveying unit is set for the forward route and the backward route for the conveying unit.

Further, as another aspect of the dust container, a different conveying face shape provided for conveyance is set in the forward route and the backward route for the conveying unit.

Further, as another aspect of the dust container, the difference in conveying face shape set in the forward route and the backward route for the conveying unit is set by making angles of the conveying faces different.

Further, as another aspect of the dust container, the dust conveying and pressurizing unit is disposed to face an almost entire area of a containing area for dust to be fed, and it moves in a height direction of dust to be fed to pressurize the dust.

Further, as another aspect of the dust container, the dust conveying and pressuring unit makes dust height even by pressuring the dust.

Further, as another aspect of the dust container, the dust conveying and pressuring unit is configured by combining a pressurizing mechanism with a unit that conveys the dust provided separately from the pressurizing mechanism.

Further, as another aspect of the dust container, the dust conveying and pressuring unit is configured by providing a pressurizing unit at a part of the dust conveying unit.

Further, as another aspect of the dust container, a movement amount of the dust conveying and pressuring unit in a height direction is set equal to or more than 1 millimeter.

Further, as another aspect of the dust container, a part of the conveying unit has a face where a lower area in a horizontal direction is made larger than an upper area in a height direction.

Further, as another aspect of the dust container, a part of the conveying unit has a triangle shape in section.

Further, as another aspect of the dust container, a part of the conveying unit has an inverted T shape in section.

As another aspect of the dust container, a part of the conveying unit has a shape inclined along a horizontal direction.

Further, as another aspect of the dust container, inclination of a part of the conveying unit is provided by setting an angle ($\theta$) to a perpendicular line to −70 to +70 degrees.

Further, as another aspect of the dust container, a part of the conveying unit has a rib structure.

Further, as another aspect of the dust container, a part of the conveying unit is disposed to be separated from the bottom face defining a space where the conveying unit is accommodated.

Further, as another aspect, a toner container uses the dust container.

Further, as another aspect, an image forming apparatus uses the toner container.

Further, as another aspect, the image forming apparatus uses the toner container as a toner collecting unit after image formation.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A dust container configured to contain dust therein, comprising:

a container body configured to contain the dust therein;

an inlet to the container body for passing the dust therethrough;

a dust conveying unit that conveys the dust from the inlet to a portion away from the inlet inside the container body, the dust conveying unit including a plurality of conveying members arranged at different positions in the dust conveying unit and operating to urge the dust in a predetermined direction within the container, at least one of the conveying members of the plurality of conveying members being different with respect to others of the plurality of conveying members in at least any one of a dust conveying direction and a dust conveying amount;

a dust detector configured to detect whether the container body is substantially full with the dust, and wherein the dust conveying unit further includes a regulating plate that is configured to regulate a flow of the dust generated by the plurality of conveying members.

2. A dust container configured to contain dust therein, comprising:

a container body configured to contain the dust therein;

an inlet to the container body for passing the dust therethrough;

a dust conveying unit that conveys the dust from the inlet to a portion away from the inlet inside the container body, the dust conveying unit including a plurality of conveying members arranged at different positions in the dust conveying unit, at least one of the conveying members of the plurality of conveying members being different with respect to others of the plurality of conveying members in at least any one of a dust conveying direction and a dust conveying amount;

a dust detector configured to detect whether the container body is substantially full with the dust;

wherein at least one of the dust conveying directions is in a direction toward the dust detector, and at least one of the dust conveying directions is in a direction away from the dust detector, and wherein the dust conveying unit further includes a regulating plate that is configured to regulate a flow of the dust generated by the plurality of conveying members.

3. The dust container according to claim 2, wherein the dust conveying unit substantially reciprocates to convey the dust, and each conveying member of the plurality of conveying members being arranged at a different position on a plane substantially parallel to a broader face of the container body, and includes a plurality of conveying sub-members, each conveying sub-member of which a plane of a broader face is set a predetermined angle to a direction in which the dust conveying unit reciprocates.

4. The dust container according to claim 3, wherein the conveying sub-members in one conveying member are substantially parallel to each other and there being a gap between any two adjacent conveying sub-members, the gap between any two adjacent conveying sub-members of one conveying member is different from that of another conveying member.

5. The dust container according to claim 1, wherein the plurality of conveying members are integrally formed.

6. The dust container according to claim 2, wherein the dust conveying unit includes a frame member having a plurality of sub-frames, and the conveying unit detachably fits into the sub-frame.

7. A dust container configured to contain dust therein, comprising:

a container body configured to contain the dust therein;

an inlet to the container body for passing the dust therethrough;

a dust conveying unit that conveys the dust from the inlet to a portion away from the inlet inside the container body, the dust conveying unit including a plurality of conveying members arranged at different positions in the dust conveying unit, at least one of the conveying members of the plurality of conveying members being different with respect to others of the plurality of conveying members in at least any one of a dust conveying direction and a dust conveying amount; and a dust detector configured to detect whether the container body is substantially full with the dust;

wherein the dust conveying unit further includes a regulating plate that is configured to regulate a flow of the dust generated by the plurality of conveying members.

8. The dust container according to claim 7, wherein the regulating plate is integrally formed of the dust conveying unit.

9. The dust container according to claim 7, wherein the regulating plate is formed on at least any one of an upper portion and a lower portion of the dust conveying unit.

10. The dust container according to claim 3, further comprising:

a supporting member that is arranged on a lower portion of a bottom face of the dust conveying unit, a position at which the supporting member supports the conveying unit is adjustable thereby controlling a manner the dust conveying unit reciprocates.

11. The dust container according to claim 2, further comprising:

a drive unit that reciprocates the dust conveying units on a plane therein.

12. The dust container according to claim 2, further comprising:

a dust conveying and pressurizing unit that is configured to convey the dust in a direction parallel to a broader face of the container body between the inlet and the dust detector, and pressurizes the dust in a direction perpendicular to the broader face.

13. An image forming apparatus configured to form an image onto a recording medium by using toner, comprising:

a dust container including a container body configured to contain dust therein;

an inlet to the container body for passing the dust therethrough;

a dust conveying unit that conveys the dust from the inlet to a portion away from the inlet inside the container body, the dust conveying unit including a plurality of conveying members arranged at different positions in the dust conveying unit and operating to urge the dust in a predetermined direction within the container, at least one of the conveying members being different with respect to others of the plurality of conveying members in at least any one of a dust conveying direction and a dust conveying amount;

a dust detector configured to detect whether the container body is substantially full with the dust, and wherein the dust conveying unit further includes a regulating plate that is configured to regulate a flow of the dust generated by the plurality of conveying members.

14. An image forming apparatus configured to form an image onto a recording medium by using toner, comprising:

a waste toner container configured to contain waste toner therein, the waste toner container including a container body configured to contain dust therein;

an inlet to the container body for passing the dust therethrough;

a dust conveying unit that conveys the dust from the inlet to a portion away from the inlet inside the container body, the dust conveying unit including a plurality of conveying members arranged at different positions in the dust conveying unit and operating to urge the dust in a predetermined direction within the container, at least one of the conveying members being different with respect to others of the plurality of conveying members in at least any one of a dust conveying direction and a dust conveying amount;

a dust detector that detects whether the container body is substantially full with the dust, and wherein the dust conveying unit further includes a regulating plate that is configured to regulate a flow of the dust generated by the plurality of conveying members.

* * * * *